United States Patent [19]

Miller et al.

[11] Patent Number: 4,812,134

[45] Date of Patent: Mar. 14, 1989

[54] WALL MOUNTED LIGHTING TRACK SYSTEM

[76] Inventors: Ruth E. Miller; Jack V. Miller, both of 700 N. Auburn Ave., Sierra Madre, Calif. 91024

[21] Appl. No.: 198,094

[22] Filed: May 23, 1988

[51] Int. Cl.[4] ..... H01R 13/60

[52] U.S. Cl. ..... 439/110; 439/573

[58] Field of Search ..... 439/110–120, 439/571, 573–576

[56] References Cited

U.S. PATENT DOCUMENTS

| | | | |
|---|---|---|---|
| 3,166,370 | 1/1965 | Parker | 439/115 |
| 3,686,613 | 8/1972 | Barski | 439/116 |
| 4,173,382 | 11/1979 | Booty | 439/117 |

*Primary Examiner*—Joseph H. McGlynn

[57] ABSTRACT

A lighting track system for mounting to a vertical wall includes an elongated channel in the form of an inverted U with a horizontal web having an upper surface and connecting two depending legs, the channel retaining one or more electrical conductors extending therethrough, insulated from each other and the channel, and accessable for electrical connection from the open side of the channel. At least one of the vertical legs of the channel has an upstanding or depending flange that is provided with screws for attachment of the track to a vertical wall. An external source of power is connected to the electrical conductors, and one or more lighting fixture connectors mechanically attach and electrically connect to the track at any point along its length. In a preferred embodiment the track has a depending flange that terminates in an upturned lip for the support of suspended objects, such as paintings, wall hangings and drapes. An alternate preferred embodiment has both upstanding and depending vertical flanges for wall attachment.

13 Claims, 2 Drawing Sheets

WALL MOUNTED LIGHTING TRACK SYSTEM

BACKGROUND OF THE INVENTION

The need for versatility in the placement and rearrangement of lighting fixtures in rooms has led to the development of many types of track lighting systems in which a number of lighting fixtures may be installed in any location along the length of one or more electrified track channels. Electrical conductors are commonly supported within elongated insulating structures within a rigid metallic and downward-facing channel to form what is commonly called lighting track. The tracks are rigid lengths of structural metals, such as aluminum or steel, carrying the insulated conductors; and are electrically fed and joined by various connecting means, as shown in the Neumann Pat. No. 3,295,093 that includes a wireway space for extra downstream conductors; and others tie directly to a junction box above the ceiling, as shown in the Galindo Pat. No. 4,414,617.

Prior art track system are sometines used on vertical walls, as shown in the Bishop Pat. No. 4,245,874. However, these prior uses involved conventional ceiling track channel construction in which the channel and conductors are open in the horizontal direction, facing an observer in the room. Although sometimes used in this manner, ceiling tracks are visually wide and aesthetically displeasing.

SUMMARY OF THE INVENTION

A primary purpose of the present invention is to provide a lighting track system that is well suited to wall mounting for such applications as wall-wash lighting, corridor lighting and oil painting illumination.

It is a further purpose of the present invention to provide a wall mountable lighting track that includes a means for simultaneously suspending and illuminating items such as paintings, wall decorations and drapes.

The achievement of the foregoing purposes of the invention is accomplished by a lighting track system for mounting to a vertical wall includes an elongated channel in the form of an inverted U with a horizontal web having an upper surface and connecting two depending legs, the channel retaining one or more electrical conductors extending therethrough and insulated from each other and the channel. At least one of the vertical legs of the channel has an upstanding or depending flange that is provided with screws for attachment of the track to a vertical surface, such as a wall. An external source of power is connected to the electrical conductors, and one or more lighting fixture connectors mechanically attach and electrically connect at any point along the length of the track. In a preferred embodiment the track has a depending flange that terminates in an upturned lip for the support of suspended objects, such as paintings, wall decorations and drapes.

DETAILED DESCRIPTION OF THE DRAWINGS

Figure 1:
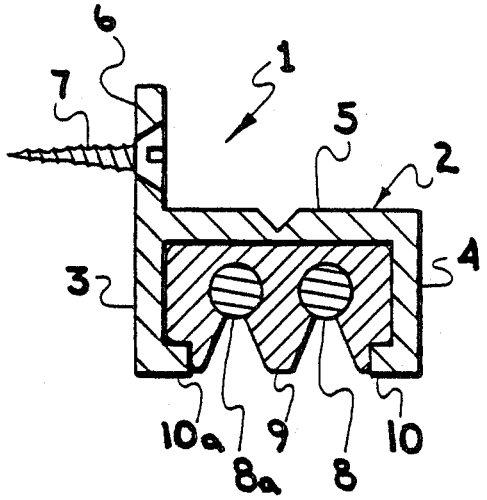
FIG. 1 shows a cross-sectional elevation view of a wallmounted lighting track according to a preferred embodiment of the invention.

In FIG. 1 a lighting track 1 according to a first preferred embodiment of the invention is shown having an inverted U-shaped channel 2 including a first depending leg 3 and a second depending leg 4 connected by a horizontal web 5. A vertical upstanding flange 6 is contiguous with vertical leg 3 and is provided with fasteners 7 for attachment to a vertical wall. A pair of parallel and spaced apart electrical conductors 8 and 8a are connected to and external source of electrical power, and are disposed within and partially enclosed by an insulator 9, which is retained in channel 2 by a pair of inward-projecting ledges 10 and 10*a*.

Figure 2:
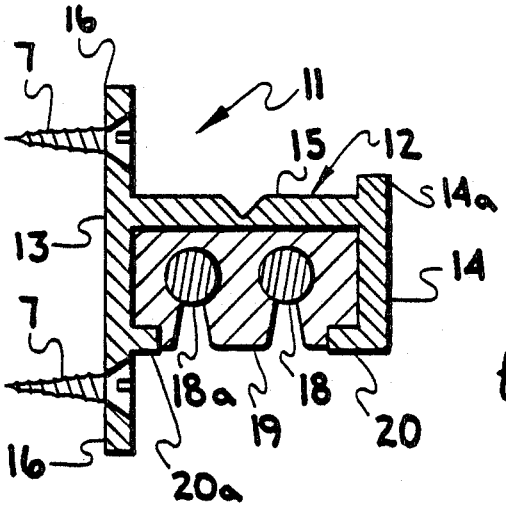
FIG. 2 shows a cross-sectional elevation view of a wallmounted track according to a second preferred embodiment.

In FIG. 2 a lighting track 11 according to a second preferred embodiment of the invention is shown having an inverted U-shaped channel 12 including a first depending leg 13 and a second depending leg 14 having an upstanding hanger retaining rib 14a connected by a horizontal web 15. A vertical flange 16 is contiguous with vertical leg 13, extends both above and below the channel and is provided with fasteners 7 for attachment to a vertical wall. A pair of parallel and spaced apart electrical conductors 18 and 18a are connected to an external source of electrical power, and are disposed within and partially enclosed by an insulator 19, which is retained in channel 12 by a pair of inward-projecting ledges 10 and 10*a*.

Figure 3:
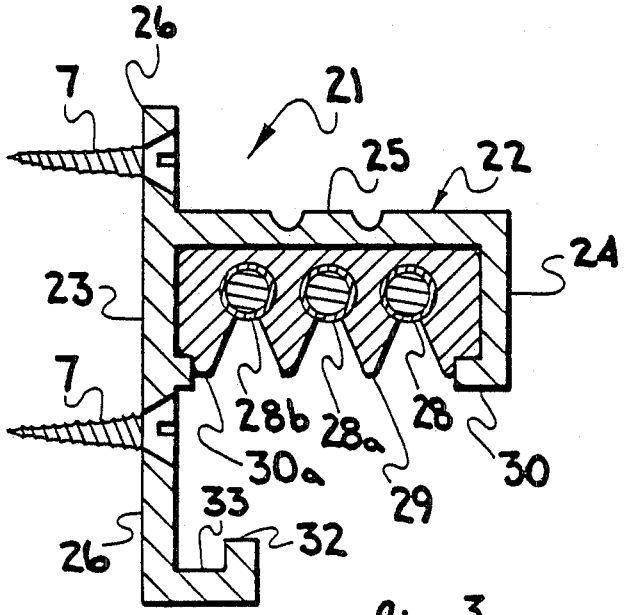
FIG. 3 shows a cross-sectional elevation view of a wallmouned track according to a third preferred embodiment.

In FIG. 3 a lighting track 21 according to a third preferred embodiment of the invention is shown having an inverted U-shaped channel 22 including a first depending leg 23 and a second depending leg 24 connected by a horizontal web 25. A vertical flange 26 is contiguous with vertical leg 23, extends both above and below the channel and is provided with fasteners 7 for attachment to a vertical wall. Three parallel and spaced apart electrical conductors 28, 28*a* and 28*b* are connected to a source of electrical power and are disposed within and partially enclosed by an insulator 29, which is retained in channel 22 by a pair of inward-projecting ledges 30 and 30*a*. The electrical conductors are shown in FIG. 3 as insulated wires, but may alternately be bare wires as shown in FIG. 1 and 1. The portion of flange 26 depending below channel 22 is provided with an upturned lip 32 on a horizontal ledge 33.

Figure 4:
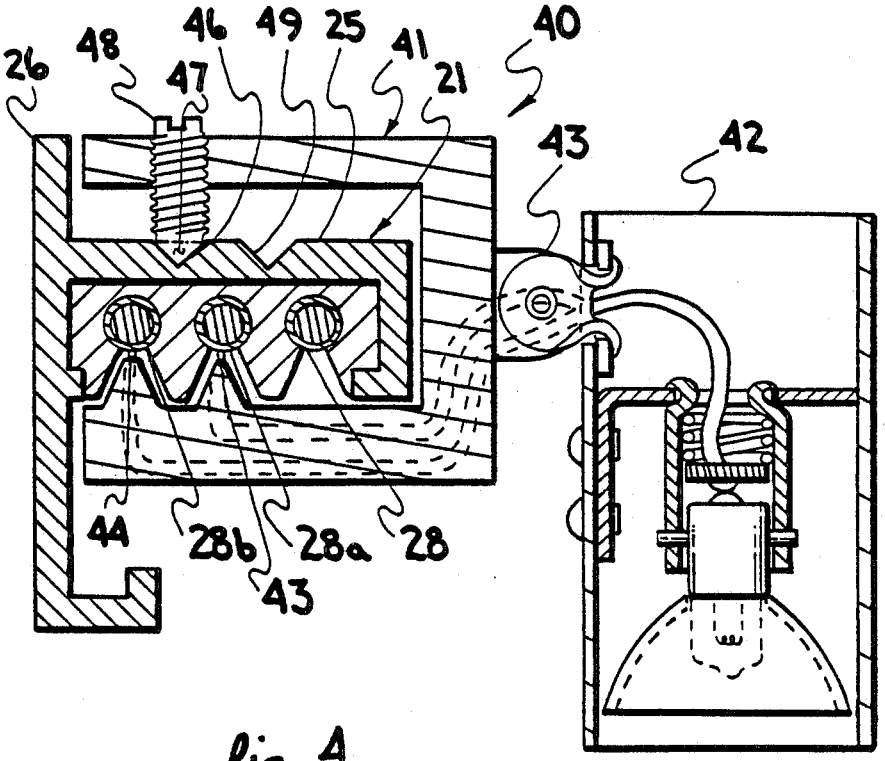
FIG. 4 shows a cross-sectional elevation view the track of FIG. 3 with a lighting fixture connector attached.

In FIG. 4 lighting track 21 is shown having a fixture connector 40 supporting and connecting a lighting fixture 42 through a pivot 43. Fixture connector 40 has a generally U-shaped body 41 carrying insulated and sharp-edged electrical contacts 43 and 44, which are urged into electrical contact by piercing the insulation of conductors 28*a* and 28*b*, respectively, of a first circuit by mechanical force applied against a groove 46 by a point 47 of a screw 48. Fixture connector 40 may alternately connect the lighting fixture 42 to a second electrical circuit including conductors 28 and 28*a*, by loosening screw 48 and moving it so that its conical point 47 is engaged into groove 49. Of course the fixture connector 40 may also be installed as easily onto either of the single-circuit track embodiments shown in FIGS. 1 and 2.

It will be obvious to anyone skilled in the art that the number of conductors may be increased or decreased as a matter of design choice. The track system as disclosed will function as a low voltage track with only one conductor, using the metal channel as a ground. The system will also operate as described with four or more conductors in a multi-circuit mode, as long as the fixture connector has a deep enough U shape to reach the innermost conductors. Therefore changes in the number of conductors is clearly within the scope of the present invention. It should be also noted that any type of conductors may be used in the present invention, bare round solid wire as shown, insulated solid wire, insulated stranded wire, or oval or flat wire forms within the intended scope of the invention.

It will also be obvious to those skilled in the art that the orientation of the track channel could be changed, so that the open side with conductor access faces upwards or even horizontally with respect to the wall mouonting flange means. These orientations have been considered by the inventors. In the interest of brevity of the present application, those orientations that would create hazardous conditions have not been described in this application, but are considered within the scope of the invention. For instance, facing the track channel upwards would be possible, but would accumulate debris, moisture, etc., and facing the channel towards the wall would require blind installation and possible misorientation of the fixture connectors. Therefore the inventors have limited the disclosure to those embodiments they consider inherently safe and practical.

We claim:

1. A lighting track system for mounting to a vertical wall including:

an elongated channel in the form of an inverted U with a horizontal web having an upper surface and connecting first and second depending legs, the channel retaining one or more electrical conductors extending therethrough, connectable to a source of external power, insulated from each other and the channel and accessible for connection from the open side of the channel;

means for attaching the first vertical leg to a wall; and means for making mechanical and electrical connection to the channel and conductors along the length of the track.

2. A lighting track system for mounting to a vertical wall according to claim 1 in which the means for attaching the first vertical leg to a wall is an upstanding rib contiguous at its proximal end with said first vertical leg and attachable to the wall with a plurality of screws.

3. A lighting track system for mounting to a vertical wall according to claim 1 in which the means for attaching the first vertical leg to a wall is an upstanding rib and a depending rib, both being contiguous with said first vertical leg and attachable to the wall with a plurality of screws.

4. A lighting track system for mounting to a vertical wall according to claim 1 in which the means for attaching the first vertical leg to a wall is a depending rib contiguous at its proximal end with one vertical leg and terminating at its distal end in an upturned lip.

5. A lighting track system for mounting to a vertical wall according to claim 1 in which the conductors are insulated wires retained in a partially enclosing elongated insulator.

6. A lighting track system for mounting to a vertical wall according to claim 1 in which the conductors are disposed in a parallel, spaced-apart relationship in the horizontal plane.

7. A lighting track system for mounting to a vertical wall according to claim 1 in which the conductors are disposed in a parallel, spaced-apart relationship in the horizontal plane, wherein the horizontal web of the channel is provided with an elongated, recessed groove in its upper surface which is horizontally located between the conductors, and the means for making mechanical and electrical connection to the channel and conductors along the length of the track is a lighting fixture connector.

8. A lighting track system for mounting to a vertical wall according to claim 7 in which a lighting fixture is electrically and mechanically coupled to the channel and the conductors by the lighting fixture connector urging a plurality of electrical contacts into engagement with the track conductors by the application of force against the recessed groove in the top surface of the channel.

9. A lighting track system for mounting to a vertical wall according to claim 8 in which the conductors are insulated wires and the electrical contacts are sharp-edged and make electrical contact with the conductors by piercing the insulation of the wires.

10. A lighting track system for mounting to a vertical wall according to claim 8 in which the lighting fixture connector is in the shape of a horizontal U, in which the electrical contacts are disposed in a first leg of the U and the force is applied against the recessed groove by a means disposed in the second leg of the U.

11. A lighting track system for mounting to a vertical wall according to claim 9 in which the lighting fixture connector is in the shape of a horizontal U, in which the electrical contacts are disposed in a first leg of the U and the force is applied against the recessed groove by a means disposed in the second leg of the U.

12. A lighting track system for mounting to a vertical wall according to claim 10 in which the force applying means is a sharp-pointed screw threaded through the second leg of the U and providing an electrical ground for the lighting fixture.

13. A lighting track system for mounting to a vertical wall according to claim 1 in which the second depending leg is provided with an elongated rib upstanding above the top surface of the horizontal web connecting the legs of the channel.

* * * * *